US012806506B2

(12) United States Patent
Moore

(10) Patent No.: US 12,806,506 B2
(45) Date of Patent: Nov. 24, 2026

(54) PLAYING CARD CASE

(71) Applicant: Cameron Robinson Moore, Huntington Beach, CA (US)

(72) Inventor: Cameron Robinson Moore, Huntington Beach, CA (US)

( * ) Notice: Subject to any disclaimer, the term of this patent is extended or adjusted under 35 U.S.C. 154(b) by 130 days.

(21) Appl. No.: 18/626,062

(22) Filed: Apr. 3, 2024

(65) Prior Publication Data

US 2025/0312683 A1 Oct. 9, 2025

(51) Int. Cl.
*A63F 1/06* (2006.01)

(52) U.S. Cl.
CPC ..... *A63F 1/062* (2013.01)

(58) Field of Classification Search
CPC ..... A63F 1/062
USPC ..... 273/148 A; 206/0.8, 0.81
See application file for complete search history.

(56) References Cited

U.S. PATENT DOCUMENTS 1,197,736 A * 9/1916 Hartford et al. ..... G09F 13/12 200/DIG. 3
6,814,227 B2 * 11/2004 Seligman ..... A47G 1/12 206/8
D1,104,589 S * 12/2025 Boyd ..... D7/564
2007/0252328 A1 * 11/2007 Mendoza ..... B65D 81/36 220/592.2
2016/0316870 A1 * 11/2016 Guy ..... A45C 11/00
2017/0050106 A1 * 2/2017 Nichols ..... A63F 1/062

* cited by examiner

*Primary Examiner* — Jacob K Ackun
(74) *Attorney, Agent, or Firm* — Eric Karich; Karich & Associates

(57) ABSTRACT

A playing card case has a housing with a base and a sidewall that extends upwardly from the base to an upper perimeter, wherein the housing forms an inner chamber sized and adapted to contain a deck of playing cards. A cover panel is mounted and extends across the upper perimeter to cover the inner chamber. A coin receiving recess is formed in the cover panel, the coin receiving recess having a wall that extends from a bottom surface. The wall has a circular cross section portion with a diameter that is sized to receive and engage a challenge coin having a disk-shaped body having opposing surfaces that extend outwardly to a coin perimeter.

10 Claims, 4 Drawing Sheets

PLAYING CARD CASE

BACKGROUND OF THE INVENTION

Field of the Invention

This invention relates generally to playing cards, and more particularly to a playing card case adapted to display a challenge coin.

Description of Related Art

Playing card cases are widely known to the public, and are typically used simply as storage/protection for a deck of playing cards. In the instance that playing cards are displayed in such a case, the prior art is directed toward booklets, furniture display cases, and stands as for business cards.

Challenge coins are said to have originated during World War I, where they were carried by military units as signs of membership. In at least one instance a challenge coin was used by a downed aircraft pilot to prove his identity to Allied soldiers when escaping across no-man's land. It became tradition to ensure that all members carried their challenge coin at all times, and if they failed to produce it upon demand, they were required to buy a drink for the challenger.

The prior art does not teach a playing card case having a kickstand for standing the case upright for display of both the case and a challenge coin. The present invention fulfills these needs and provides further advantages as described in the following summary.

SUMMARY OF THE INVENTION

The present invention teaches certain benefits in construction and use which give rise to the objectives described below.

The present invention provides a playing card case for storing a deck of playing cards. The playing card case comprises a housing having a base and a sidewall that extends upwardly from the base to an upper perimeter, wherein the housing forms an inner chamber sized and adapted to contain the deck of playing cards; and a cover panel mounted on and extending across the upper perimeter to cover the inner chamber. A challenge coin is provided, which fits within a coin receiving recess formed in the cover panel. The coin receiving recess has a wall that extends upwardly from a bottom surface, the wall being sized and shaped to receive and engage the challenge coin.

A primary objective of the present invention is to provide a playing card case having advantages not taught by the prior art.

Another objective is to provide a playing card case having a kickstand for standing the case upright for display of both the case and a challenge coin Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention.

DETAILED DESCRIPTION OF THE INVENTION

The above-described drawing figures illustrate the invention, a playing card case for storing a deck of playing cards, and for displaying a challenge coin.

Figure 1:
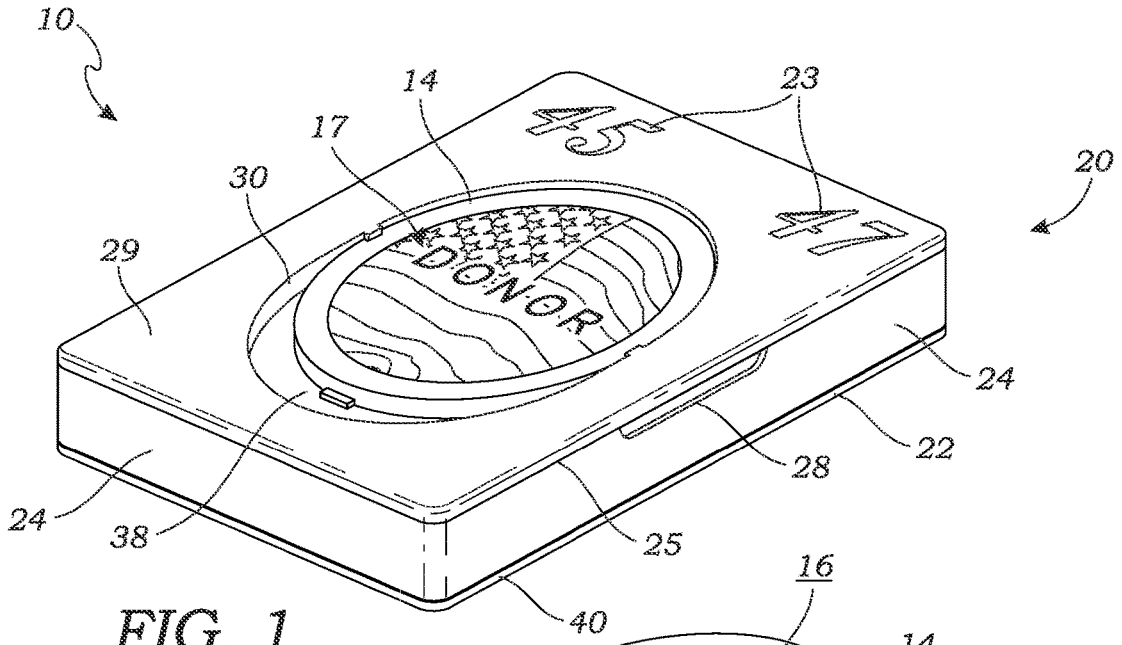
FIG. 1 is a perspective view of a playing card case according to one embodiment of the present invention and shown with a challenge coin in a coin receiving recess of the playing card case.
Figure 2:
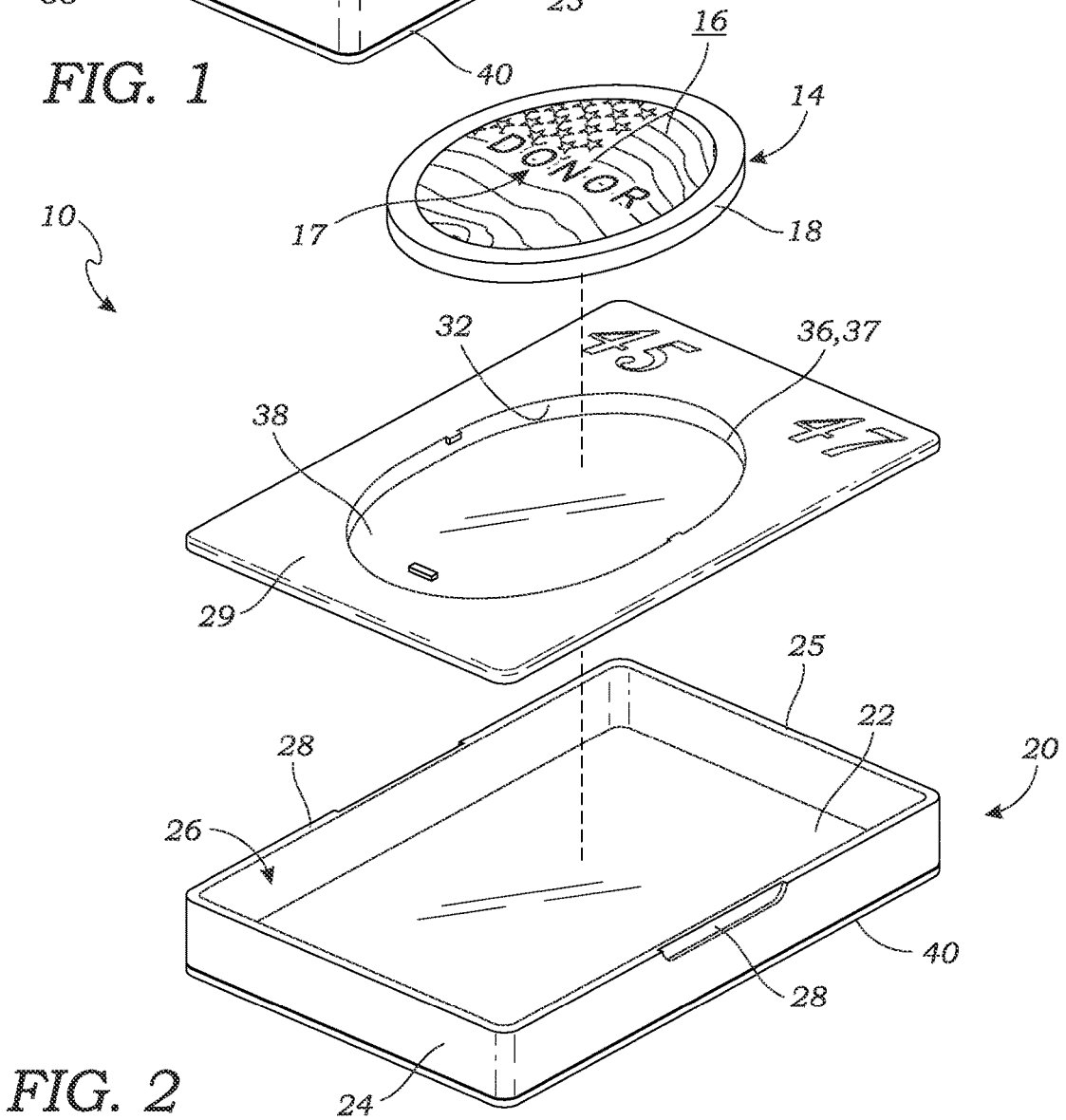
FIG. 2 is an exploded perspective view thereof.

FIG. 1 is a perspective view of a playing card case 10 according to one embodiment of the present invention and shown with a challenge coin 14 in a coin receiving recess 30 of the playing card case 10. FIG. 2 is an exploded perspective view thereof. As shown in FIGS. 1-2, the playing card case 10 comprises a housing 20 having a base 22 and a sidewall 24 that extends upwardly from the base 22 to an upper perimeter 25, wherein the housing 20 forms an inner chamber 26 sized and adapted to contain a deck of playing cards (not shown). In some embodiments, the housing 20 has a rectangular base 22, and four sidewalls 24 extend upwardly from the base 22. The housing 20 may be constructed of transparent plastic, such that the deck of playing cards is visible while stored within the playing card case 10. However, the housing 20 could alternatively be opaque, and could be constructed of a wide range of materials (e.g., various plastic polymers, metal, glass, etc.), either alone or in combination.

As illustrated, a cover panel 29 is mounted on and extends across the upper perimeter 25 to cover the inner chamber 26 and hold the deck of playing cards within the inner chamber 26. In this embodiment, the sidewall 24 of the housing 20 includes a pair of opposing indents 28 adjacent the upper perimeter 25, and the cover panel 29 frictionally engages the upper perimeter 25, such that a person's fingers may engage the indents 28 to remove the cover panel 29 for accessing the deck of playing cards. However, in other embodiments, the cover panel 29 may be mounted on the upper perimeter 25 with a hinge (not shown), and pivot between a closed position wherein the cover panel 29 extends across the upper perimeter 25 to cover the inner chamber 26, and an open position where the cover panel 29 is moved aside so that the deck of playing cards may be removed. Furthermore, in other embodiments, the cover panel 29 may be fixedly mounted to the upper perimeter 25, wherein the deck of playing cards may be accessed through the sidewall 24 or base 22 of the housing 20 (i.e., one of the four sidewalls 24 and/or the base 22 may be hingeably attached or removably attached).

As shown in FIGS. 1-2, the coin receiving recess 30 is formed in the cover panel 29 and has a wall 32 that extends upwardly from a bottom surface 34. The wall 32 may extend inwardly to form a lip which functions to retain the challenge coin, either by extending over the coin (i.e., having a smaller diameter than the challenge coin), or having an equal diameter so that the challenge coin frictionally engages the wall. The recess 30 may have a shaped cross section portion 36 (in this case, circular) with a diameter that is sized and shaped to frictionally receive and engage the challenge coin 14.

In this embodiment, the challenge coin 14 has a disk-shaped body with opposing surfaces 16 that extend outwardly to a coin perimeter 18. The challenge coin 14 may be any form or shape of chip, token, or coin of varying size and shape that are suitable for use consistent with the teachings of this invention. The challenge coin 14 may be marked (e.g., printed, imprinted, embossed, etched, or otherwise marked in any manner known in the art) with challenge indicia (in this case "DONOR" to identify the user as a donor to a cause) and otherwise identifying indicia as to the group or cause being supported.

For purposes of this application, the term "challenge coin" is defined to mean a coin or similar easily portable token that includes challenge indicia marked thereupon, for the purpose of identifying the bearer as a member of a discrete group.

The wall 32 of the coin receiving recess 30 further has an access recess 38 that extends outwardly from the circular cross section portion 36, shaped to enable a user to access the challenge coin 14 so that the challenge coin 14 may be removed from the coin receiving recess 30. In some embodiments, the coin receiving recess 30 may include a lip 37 above the inwardly extending wall 32 that helps retain the challenge coin 14 within the recess 30, or the lip 37 may be excluded. For example, in some embodiments, the challenge coin 14 may fit snugly within the recess 30 such that it does not fall out from gravitational force when turned over. However, in other embodiments, the challenge coin 14 may fit more loosely.

As shown in FIGS. 1-2, in this embodiment, indicia 23 is embossed (or printed, or otherwise formed) on the cover panel 29. While the illustrated example shows numbers, any indicia 23 may be applied, which could in the form of other numbers, words, symbols, or any other design that can be printed, etched, embossed, adhered, or otherwise applied to the cover panel 29. Obviously, indicia 23 may also be included on other surfaces of the playing card case 10, which should be considered within the scope of the present invention.

Figure 3:
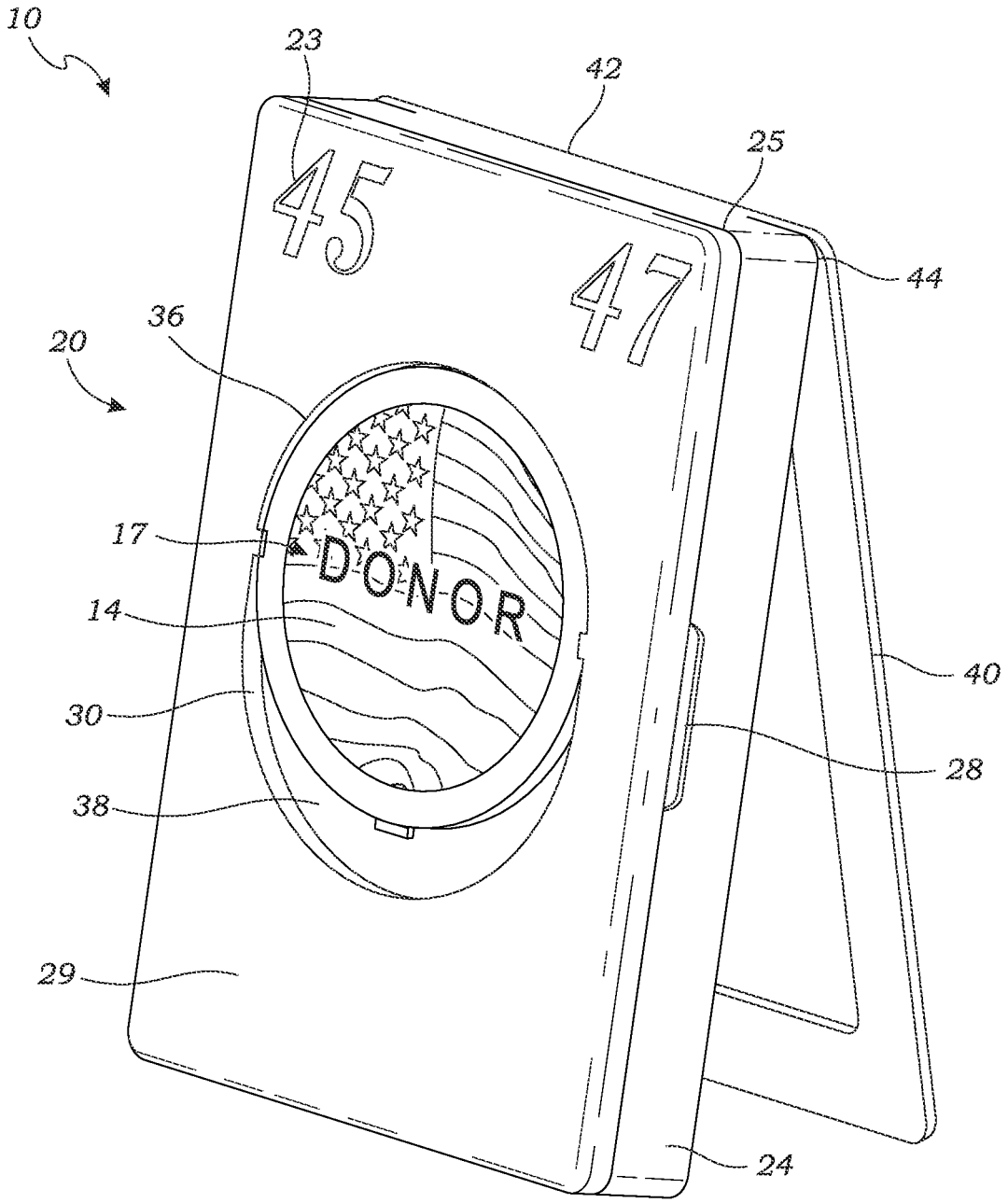
FIG. 3 is a perspective view of the playing card case, wherein a kickstand of the case has been moved to an opened position for supporting the playing card case.

FIG. 3 is a perspective view of the playing card case 10, wherein a kickstand 40 of the case 10 has been moved to an opened position for supporting the playing card case 10 in an upright position for displaying the challenge coin 14. As illustrated in FIG. 3, in some embodiments, the playing card case 10 further comprises the kickstand 40 hingeably attached to the base 22 of the housing 20. The kickstand 40 may be hinged outwardly to support the housing 20 in an upright position. In this embodiment, the kickstand 40 is in the form of a generally rectangular frame body connected with a kickstand hinge 42 to a top end 44 of the base 22 of the housing 20. However, in other embodiments, the kickstand 40 may be connected to a different part of the base 22 (located adjacent either an edge or a central area), for standing up the playing card case 10 in any desired orientation. The kickstand hinge 42 may be in the form of a spring hinge, a living hinge, or any other suitable hinge connection. In some implementations, the kickstand 40 may include additional extension pieces (not shown), to further stabilize the playing card case 10 in the upright position of FIG. 3.

Alternative kickstand structures may be manufactured within the scope of the claims of the present invention. In some embodiments, the kickstand 40 may include only a central elongate arm or a pair of arms. The kickstand 40 may also be T-shaped, triangular, or any other suitable shape. Various alternative mechanisms may also be implemented to move the kickstand 40 into the supporting position. For example, the kickstand 40 may be folded, rolled, telescopically extended, slid, or otherwise moved to the supporting position. Furthermore, in some embodiments, the kickstand 40 may be fully detachable, wherein the user may snap on or otherwise affix the kickstand 40 to the base 22 for use.

Figure 4:
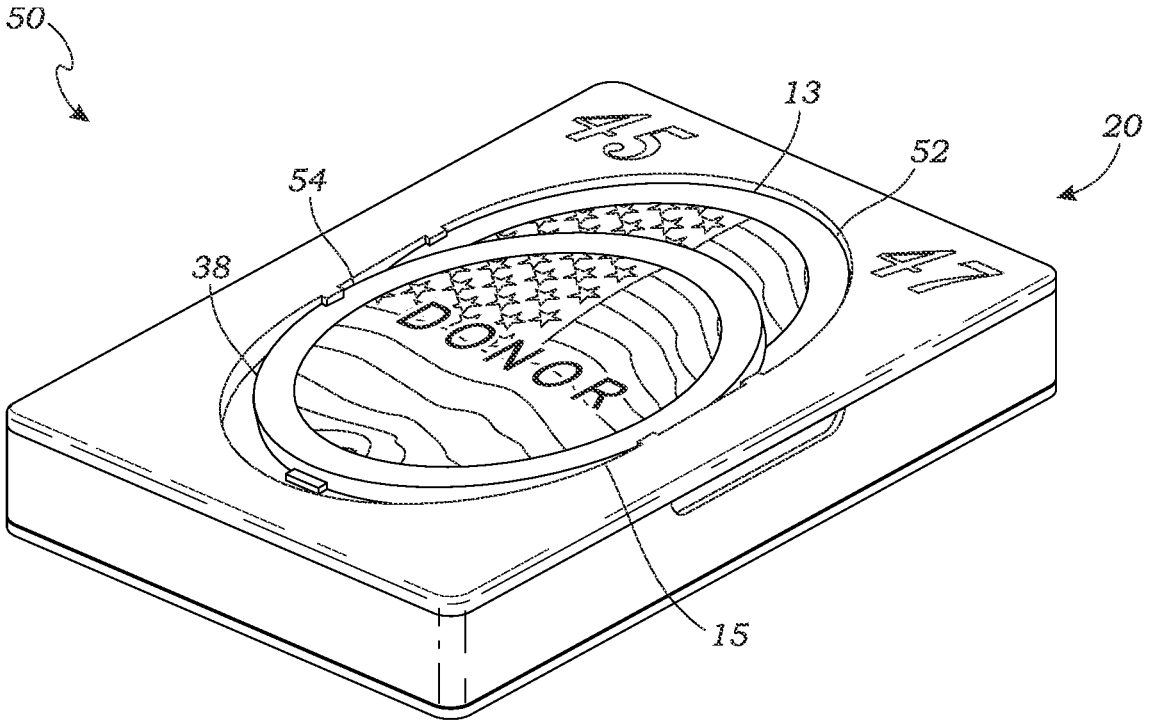
FIG. 4 is a perspective view of a second embodiment of the playing card case, wherein the coin receiving recess is adapted to receive two challenge coins.

FIG. 4 is a perspective view of a second embodiment 50 of the playing card case 10, wherein the coin receiving recess 30 is adapted to receive two coins. As shown in FIG. 4, the coin receiving recess 30 may have a depth that is great enough to receive both first and second challenge coins 13 and 15 into the coin receiving recess 30. In some embodiments, the first challenge coin 13 represents a big blind in a poker game, and the second challenge coin 15 represents a small blind in a poker game.

The coin receiving recess 30 of this embodiment may have a first circular cross section portion 52, and a second circular cross section portion 54, wherein the inwardly extending wall 32 of the first cross section portion 52 is approximately twice the length of the inwardly extending wall 32 of the second cross section portion 54. In this manner, the first and second challenge coins 13 and 15 can be placed in the coin receiving recess 30 so that the first and second challenge coins 13 and 15 overlap.

Figure 5:
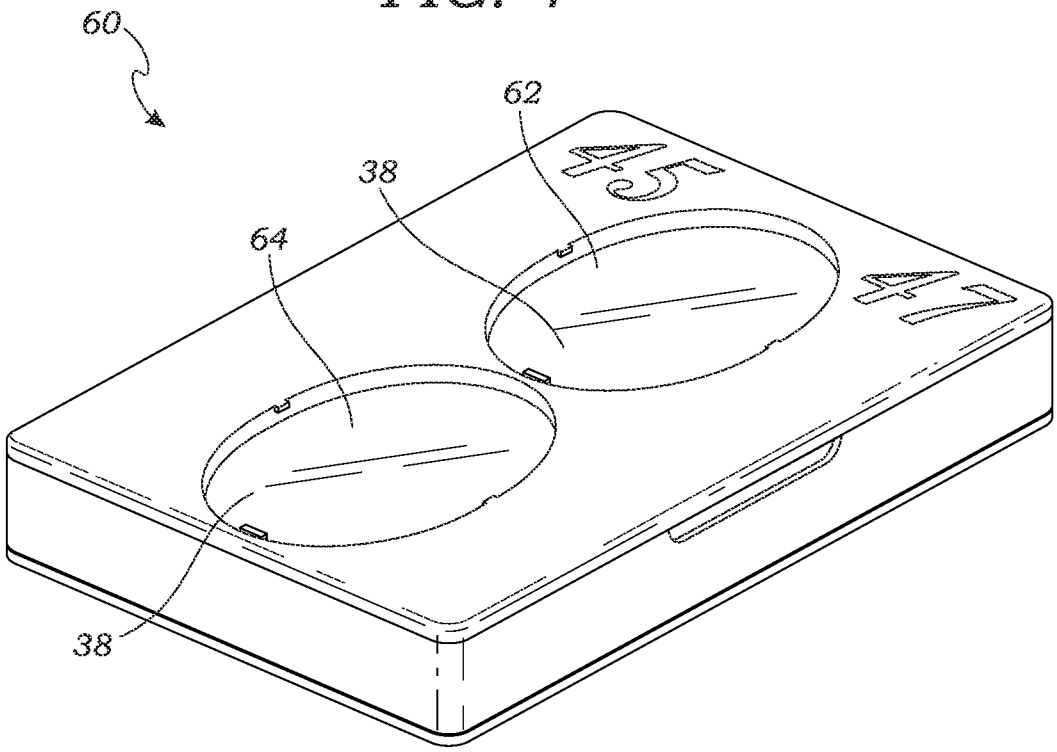
FIG. 5 is a perspective view of a third embodiment of the playing card case, wherein two separated coin receiving recesses are included for displaying two challenge coins.

FIG. 5 is a perspective view of a third embodiment 60 of the playing card case 10, wherein two separated coin receiving recesses are included. As shown in FIG. 5, in this embodiment, a first coin receiving recess 62 has a depth that is great enough to receive the first challenge coin 13, and the cover panel 29 includes a second coin receiving recess 64 that is sized and shaped to receive the second challenge coin 15. In the embodiments of FIG. 5, the first and second coin receiving recesses 62 and 64 each have an access recess 38, as described in the first embodiment.

Figure 6:
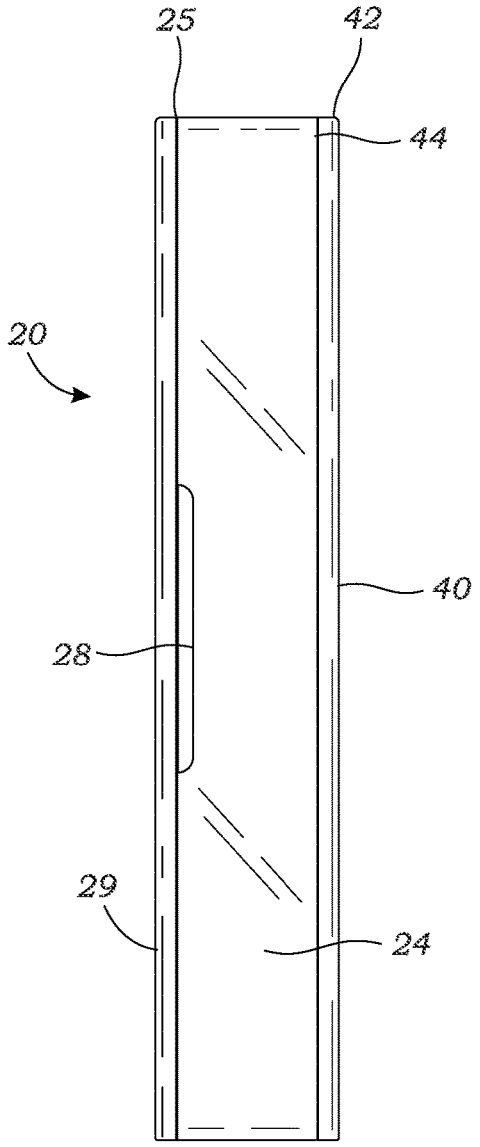
FIG. 6 is a side elevation view of the playing card case, showing the kickstand in a closed position.
Figure 7:
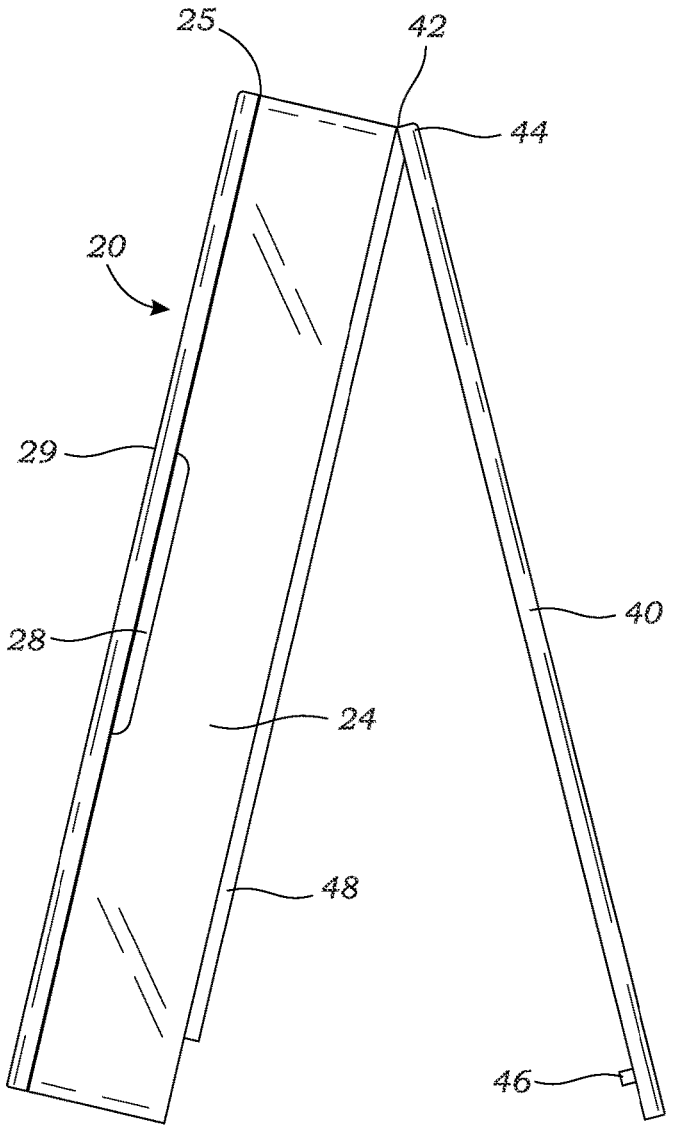
FIG. 7 is a side elevation view thereof, showing the kickstand in an open position.

FIG. 6 is a side elevation view of the playing card case 10, showing the kickstand 40 in a closed position, and FIG. 7 is a side elevation view thereof, showing the kickstand 40 in an open position. As shown in FIGS. 6-7 and described above, the kickstand 40 may be flush with the rest of the playing card case 10, or it may be opened outwardly to support the playing card case 10 for display.

The title of the present application, and the claims presented, do not limit what may be claimed in the future, based upon and supported by the present application. Furthermore, any features shown in any of the drawings may be combined with any features from any other drawings to form an invention which may be claimed.

As used in this application, the words "a," "an," and "one" are defined to include one or more of the referenced item unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. A playing card case for storing a deck of playing cards, the playing card case comprising:

a housing having a base and a sidewall that extends upwardly from the base to an upper perimeter, wherein the housing forms an inner chamber sized and adapted to contain the deck of playing cards;

a cover panel mounted on and extending across the upper perimeter to cover the inner chamber;

a challenge coin marked with a challenge indicia; and a coin receiving recess formed in the cover panel, the coin receiving recess having a wall that extends upwardly from a bottom surface, the wall being sized and shaped to receive and engage the challenge coin.

2. The playing card case of claim 1, wherein the challenge coin has a disk-shaped body with opposing surfaces that extend outwardly to a coin perimeter.

3. The playing card case of claim 1, wherein the coin receiving recess further has an access recess that extends outwardly from a circular cross section portion, shaped to enable access to the challenge coin so that the challenge coin may be removed from the coin receiving recess.

4. The playing card case of claim 1, further comprising a kickstand hingeably attached to the base of the housing, wherein the kickstand may be hinged outwardly to support the housing in an upright position.

5. The playing card case of claim 1, wherein the cover panel frictionally engages the upper perimeter for removably covering the inner chamber.

6. The playing card case of claim 4, wherein the kickstand is in the form of a generally rectangular frame body connected with a kickstand hinge to a top end of the base of the housing.

7. The playing card case of claim 1, wherein the challenge coin is disk-shaped.

8. The playing card case of claim 1, wherein the challenge coin includes a first challenge coin that represents a big blind in a poker game, and a second challenge coin that represents a small blind in a poker game.

9. The playing card case of claim 8, wherein the coin receiving recess has a depth that is great enough to receive both the first and second challenge coins into the coin receiving recess.

10. A playing card case for storing a deck of playing cards, the playing card case comprising:

a housing having a base and a sidewall that extends upwardly from the base to an upper perimeter, wherein the housing forms an inner chamber sized and adapted to contain the deck of playing cards;

a cover panel mounted on and extending across the upper perimeter to cover the inner chamber;

a challenge coin;

a coin receiving recess formed in the cover panel, the coin receiving recess having a wall that extends from a bottom surface, the wall being sized and shaped to receive and engage the challenge coin; and further comprising a kickstand hingeably attached to the base of the housing, wherein the kickstand may be hinged outwardly to support the housing in an upright position.

* * * * *